US005622127A

United States Patent [19]

Chang

[11] Patent Number: 5,622,127

[45] Date of Patent: Apr. 22, 1997

[54] AUTOMATIC DUAL BOBBIN MECHANISM

[76] Inventor: Steven Chang, 382 Rte. 304, Bardonia, N.Y. 10954

[21] Appl. No.: 495,790

[22] Filed: Jun. 27, 1995

Related U.S. Application Data

[63] Continuation-in-part of Ser. No. 271,853, Jul. 7, 1994, abandoned.

[51] Int. Cl.[6] ..... D05B 59/00

[52] U.S. Cl. ..... 112/279; 112/228

[58] Field of Search ..... 112/279, 228, 112/181, 184, 154; 242/20, 21

[56] References Cited

U.S. PATENT DOCUMENTS

| | | | |
|---|---|---|---|
| 3,376,838 | 4/1968 | Schiffmacher et al. | 112/186 |
| 3,805,719 | 4/1974 | Thompson | 112/184 |
| 4,002,130 | 1/1977 | Rovin et al. | 112/180 |
| 4,681,050 | 7/1987 | Kosmas | 112/278 |
| 5,143,004 | 9/1992 | Mardix et al. | 112/186 |

*Primary Examiner*—Paul C. Lewis
*Attorney, Agent, or Firm*—Kalow, Springut & Bressler

[57] ABSTRACT

An automatic dual bobbin mechanism is provided. A housing containing two unique bobbin casings and bobbins therein oriented side-by-side with the sewing needle and thread passing between the bobbin casing pair replaces the convention single bobbin configuration. The bobbin pair acts in a tag-team operation whereby one bobbin supplies thread to be stitched into a fabric while the second bobbin is simultaneously filled with thread from an external source. When the first bobbin is emptied, the bobbin pair is rotated 180° inside the housing. The second bobbin, now full, supplies thread for continued stitching while the first bobbin is refilled with thread supplied by the external source. The specially designed bobbins and bobbin casings allow for automatic rethreading of the empty bobbin and cutting of the bobbin thread from external source, thus eliminating the need to manually remove the empty bobbin and assembly, replace with a full bobbin and rethread.

8 Claims, 11 Drawing Sheets

ROTATION 0°

ROTATION 90°

4
1
5
54
48
52
3
18
22
46
12
20
47
27

ROTATION 180°
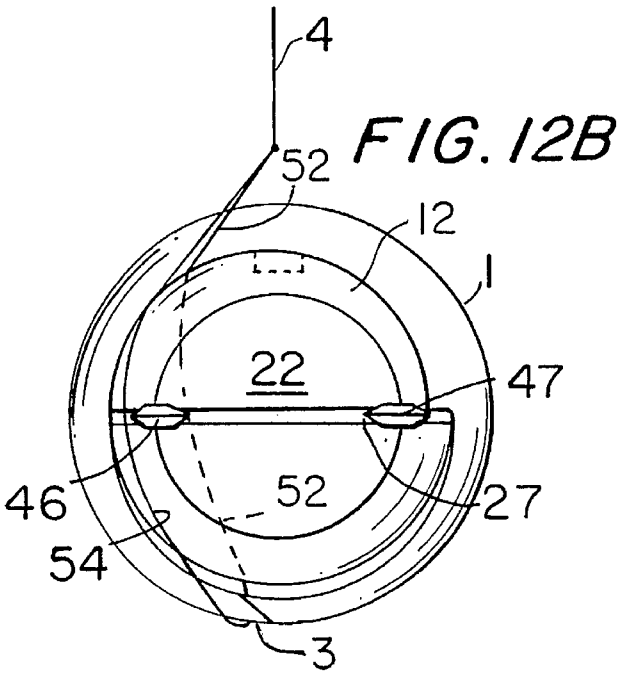
FIG. 12A
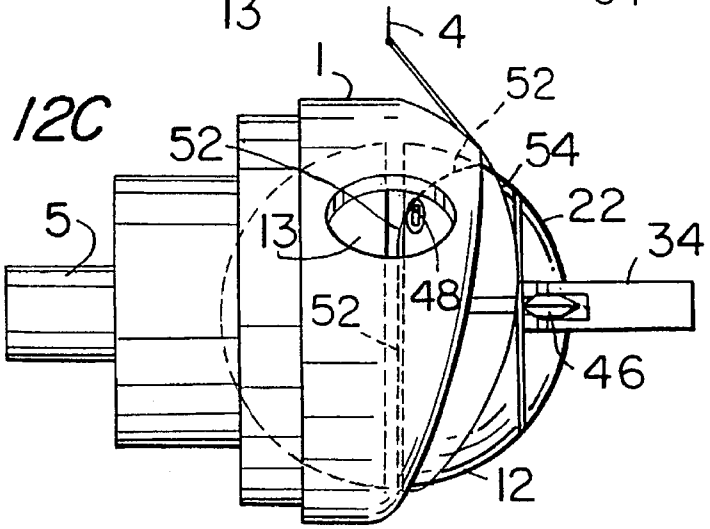
FIG. 12C
FIG. 12B

ROTATION 360°

AUTOMATIC DUAL BOBBIN MECHANISM

RELATED APPLICATION

This application is a continuation-in-part of U.S. application Ser. No. 08/271,853 filed Jul. 7, 1994, now abandoned, the contents of which are herein incorporated by reference.

BACKGROUND OF THE INVENTION

The advent of the sewing machine changed the face of the garment industry from tiny, store-front shops with a few seamstresses and tailors, into a multi-billion dollar per year operation. The sewing machine provided a fast and effective way to stitch fabric while maintaining or even surpassing the high degree of quality found in hand stitched garments. Moreover, large numbers of a single type of garment could be produced in a greatly reduced amount of time. However, sewing machines were limited by the fact that certain garments required the looping and stitching of an additional thread to properly join two pieces of fabric. This additional thread was supplied by a secondary thread source or bobbin. Bobbins were extremely limited in their thread capacity and frequently required changing. Once a bobbin was emptied of its thread, a sewing machine operator would have to stop the stitching process, manually remove the empty bobbin, replace it with a full bobbin, rethread the needle hook and needle and resume stitching. This became a time consuming process and sometimes led to poor garment construction or damaged the delicate fabrics being joined. Since the success of a garment manufacturer depended mostly on the ability to constantly supply quality clothing in a timely manner, there arose a need for a bobbin mechanism that had an increased thread supply or was capable of continuous bobbin replacement feeding to reduce "down time" during sewing machine operation.

Various improvements in bobbin technology have been made. Rovin et al. (U.S. Pat. No. 4,002,130) teaches an automatic bobbin rewinding mechanism whereby an empty bobbin and its case are removed from a sewing position and inserted to a rewinding position, while simultaneously, a filled bobbin is removed from the rewinding position and inserted to a sewing position. However, the procedure of transferring the bobbins from rewinding to sewing positions requires various mechanical components including actuators, cams, gear drives, etc. which results in a bulky frame needing to be bolted to the existing sewing machine.

Mardix et al. (U.S. Pat. No. 5,143,004) teaches a sewing apparatus which comprises a sewing needle, a bobbin for feeding thread to the sewing needle, a rotary housing containing the bobbin and its case, a sensor for sensing the non-feeding of thread to the sewing needle and an automatic extraction-loading device for extracting an empty bobbin and replacing it with a full one. This automatic bobbin-reloading system also utilizes a series of rotary actuators, pistons, etc. to remove and refill bobbins. Also, an optical sensor to detect bobbin thread-breakage or -exhaustion further adds to the complexity of the device.

Kosmas (U.S. Pat. No. 4,681,050) teaches a bobbin run-out detector and bobbin changing mechanism. The mechanism comprises a carriage which supports a rotatable turret that holds a pair of bobbins. The run-out detector, similar to that of Mardix, is also an optical sensor device. This machine however is limited in that upon detection of an empty bobbin, it must stop the sewing operation to rotate the turret to move the full bobbin into the sewing position, retract the empty bobbin and replace it with the full bobbin. Further, once the full bobbin is in position, an additional step to resynchronize the hook and bobbin is employed before sewing can continue.

SUMMARY OF THE INVENTION

Despite the advances in bobbin rewinding and transfer technology, there still is a need for improved thread run-out detection and transfer of bobbins for smooth, continuous operation without the addition of bulky frames attached to the existing machines or extra steps to rethread hooks or refill bobbins. The subject invention discloses such a device in that it is a single unit that replaces current bobbin assemblies. Two bobbins nestled in a side-by-side configuration "float" inside a housing and are never physically removed from the unit when transfer takes place. Rather, the bobbins rotate 180° within the housing from the "sewing" position to the "filling" position. The end of the housing replaces the existing thread hook and the entire unit is connected directly to the main driveshaft of the sewing machine. The thread is supplied by a single external source and constantly remains taut, allowing for automatic rethreading and refilling of the empty bobbin. Further, thread-exhaustion detection is linked directly to bobbin revolutions. A preset value of revolutions is programmed into the machine (either by manual digital counter or by computerized monitoring) so that when the set value is reached, bobbin transfer is automatic. Since the preset value is determined by thread thickness and number of thread rotations of the bobbin, the bobbin is always fully exhausted when the preset value is reached.

An improvement in existing sewing machine bobbin transfer, replacement and respooling methods is provided whereby two bobbins are constantly kept together inside a housing by specially designed bobbin casings. The housing is designed so that it can hold the bobbin casings, wrap the needle thread around one of the bobbin casings to catch bobbin thread from the newly filled bobbin and cut said bobbin thread when commencing respooling.

"Male" and "female" type connections between the bobbins allow them to spin in unison inside the casings. While one bobbin is supplying thread for stitching into fabric the other is being respooled. At a predetermined instant corresponding to the number of bobbin revolutions required to empty the full bobbin, the full and empty bobbins (and casings) are rotated inside the housing. Depending on the particular type of sewing machine the bobbins may be rotated automatically or manually.

Each bobbin casing is provided with a thread transfer groove. Once the bobbins have switched positions, the bobbin thread (under tension) travels along the grooves from the full bobbin to the empty bobbin. A hook on the empty bobbin then catches this thread and cuts it to enable respooling.

BRIEF DESCRIPTION OF THE FIGURES

FIG. 12 shows the dual bobbin mechanism from different views when rotation angle equals 180°.

DETAILED DESCRIPTION OF THE INVENTION

As sewing machines are fairly common articles and are well known to those skilled in the art of garment manufacturing, the basic functioning and operation of these machines will not be discussed. Rather, specific improvements to the existing bobbin design and replacement operation are discussed.

In the preferred embodiment of the invention, a single housing containing two bobbins replaces existing systems or components. The mechanism is attached directly to the main driveshaft of the sewing machine thereby replacing the existing bobbin assembly. Thread for refilling the empty bobbin is supplied by the main thread supply, fed through the driveshaft and into the housing. The number of revolutions required to empty a bobbin in the sewing position corresponds to revolutions required to fill a bobbin in the refilling position. Since this number is predetermined and programmed into the machine, transfer of bobbins is instantaneous and without waste or unexpected exhaustion of thread.

Figure 1:
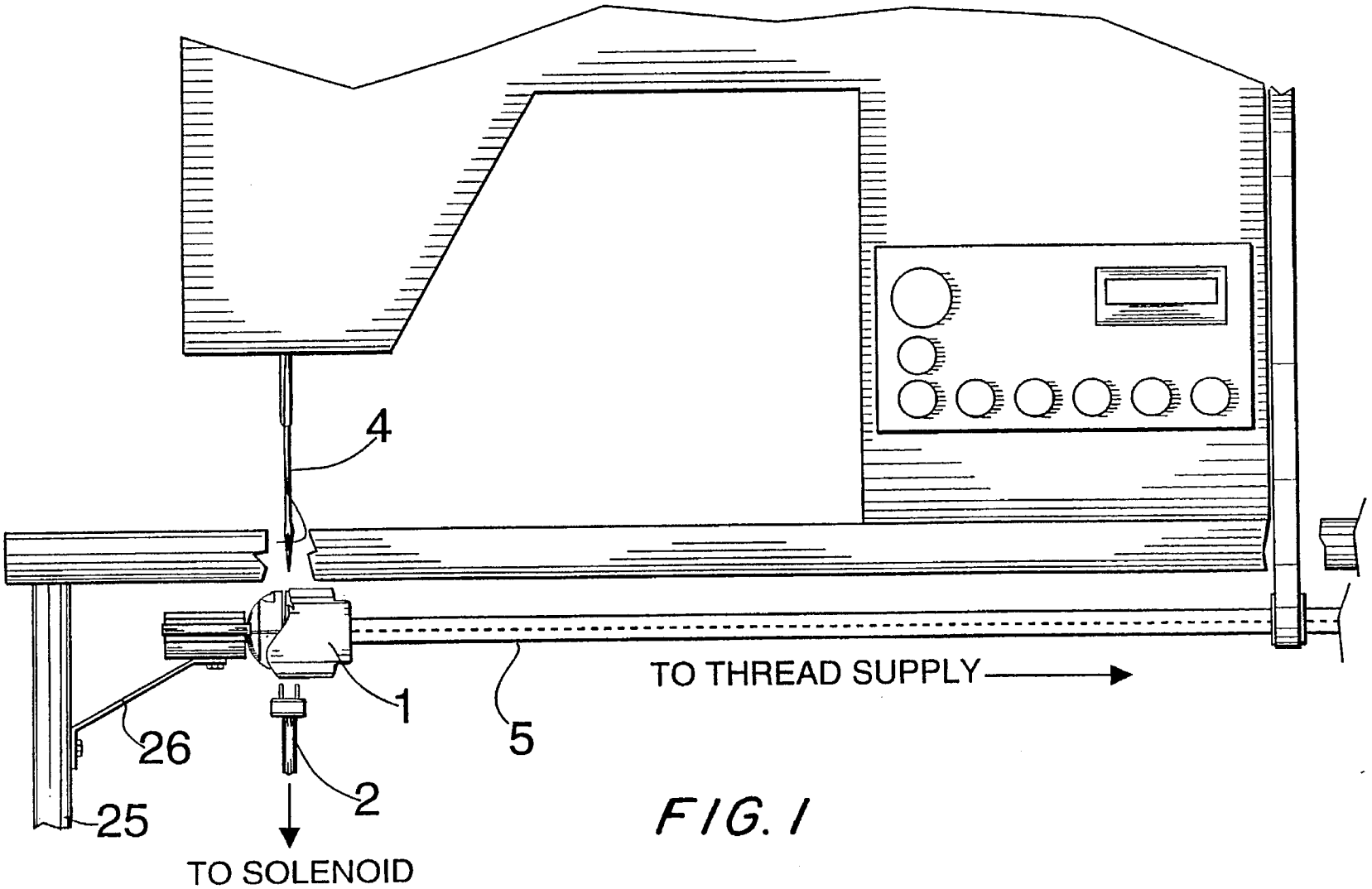
FIG. 1 is a side view of dual bobbin mechanism completely assembled to the sewing machine.
Figure 2:
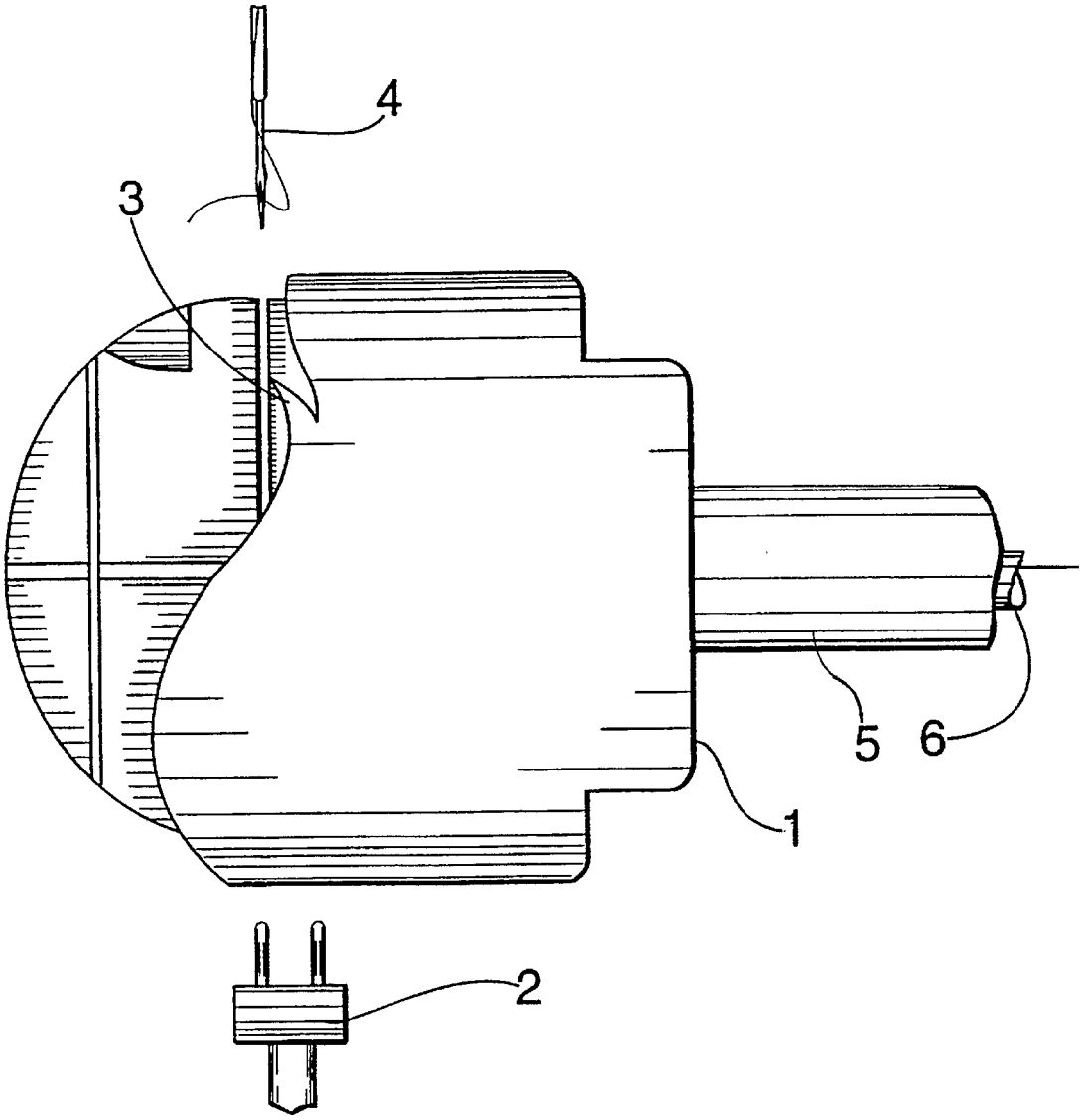
FIG. 2 is a close-up side view of the dual bobbin mechanism attached to the driveshaft of the sewing machine.

The preferred embodiment of the mechanism fully assembled and ready for operation is shown in FIG. 1 and a close-up view is shown in FIG. 2. As some new sewing machines are capable of operating at speeds up to 7000 RPM, the mechanism should be fashioned from durable materials to minimize the effects of heat and/or warpage due to friction. The mechanism should be made of a metal or alloy, preferably steel, so as to maintain its dimensions and integrity during operation. The unit is mounted on the outer rotating driveshaft (5) of the sewing machine which sits on the stationary inner shaft (6). The mechanism is oriented on the outer driveshaft so that the thread-hook portion (3) of the housing (1) rotates in a plane common to the up-and-down movement of the sewing needle (4).

Figure 3:
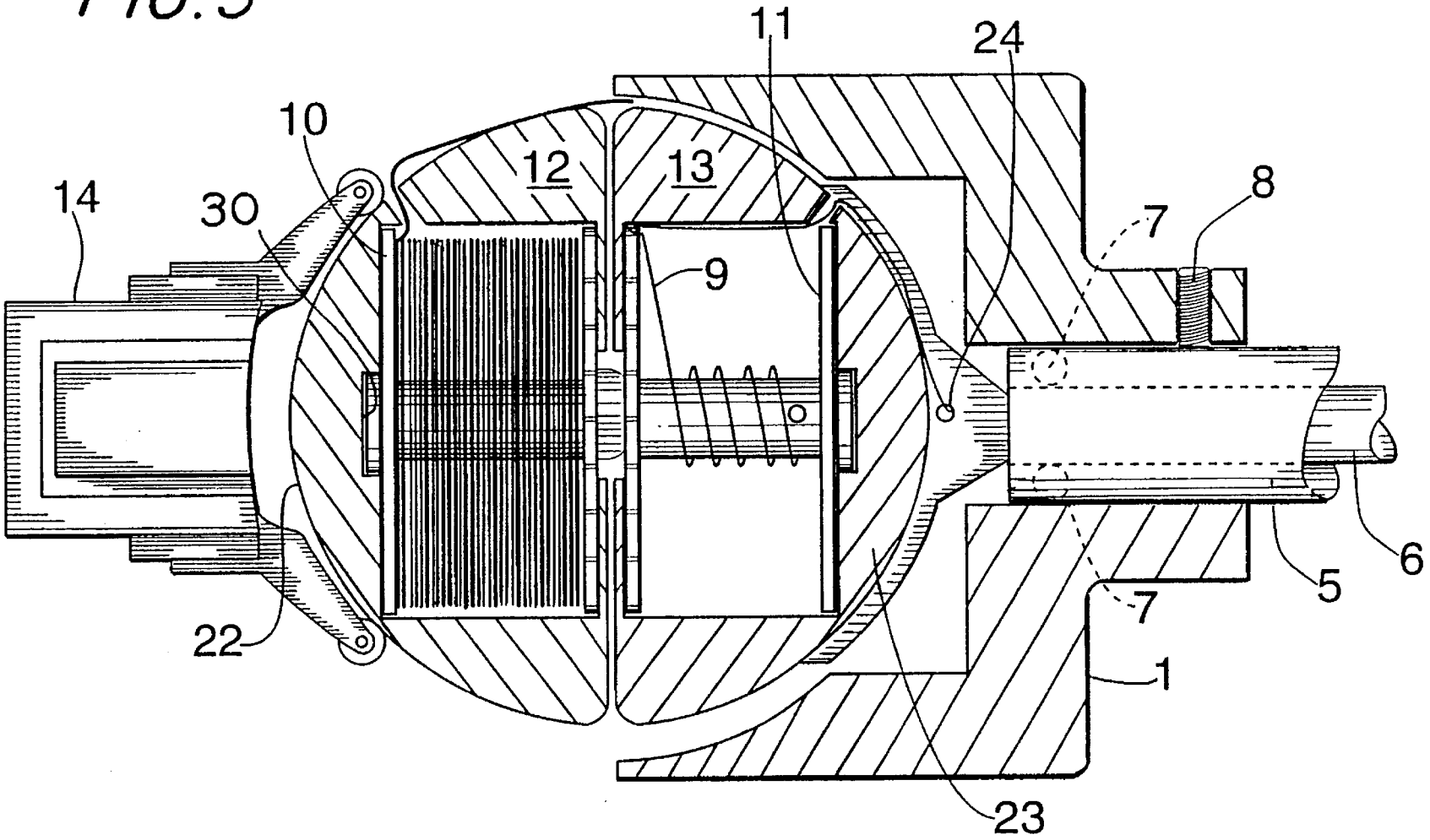
FIG. 3 is a top cutaway view of the dual bobbin mechanism with butterfly-wing stabilizer clip in place.
Figure 4:
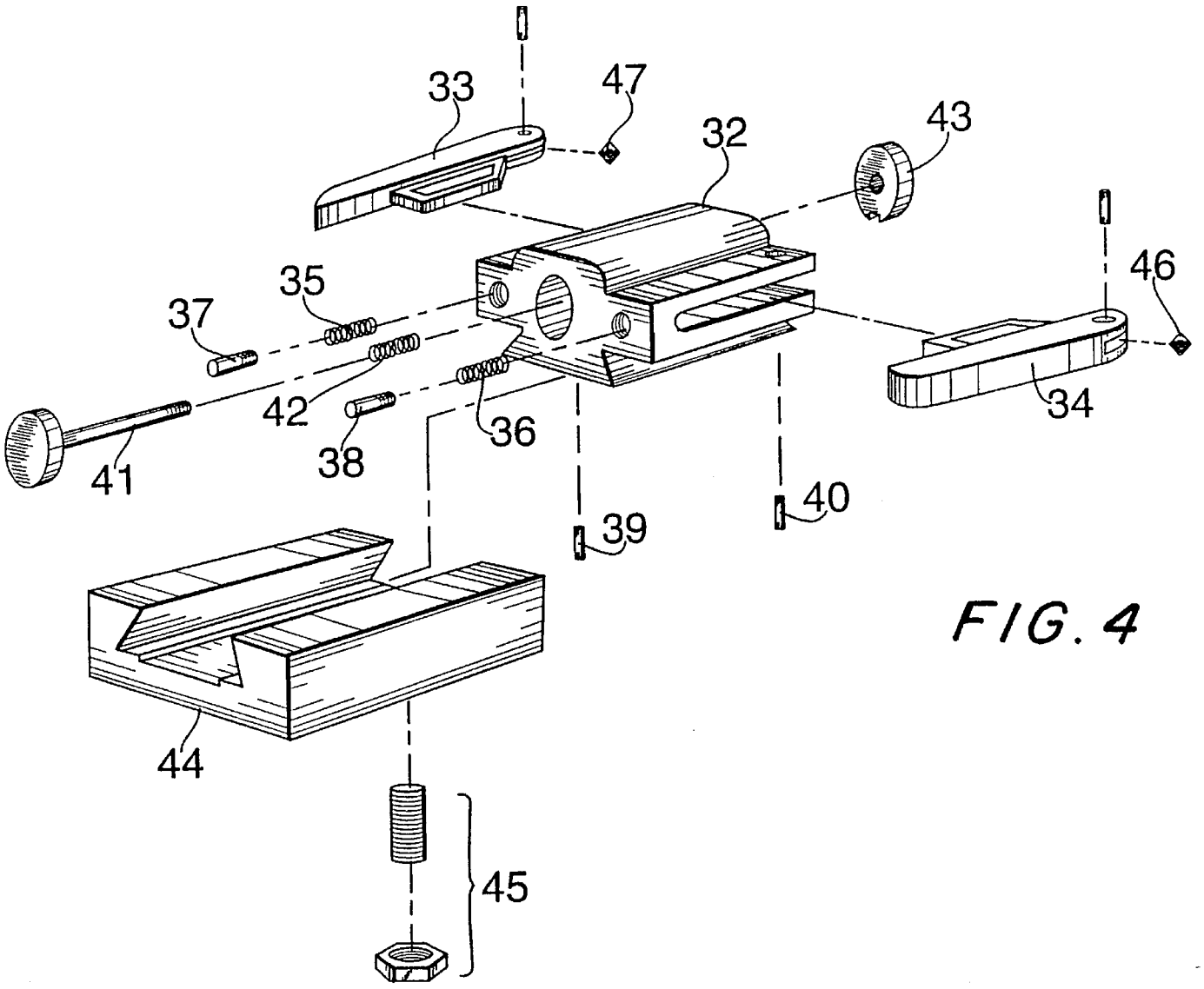
FIG. 4 is an exploded view of the butterfly-wing stabilizer clip.

FIG. 3 is a partial top cut-away view of the dual bobbin mechanism. The unit is mounted below the sewing table surface. It is attached on the right side by means of a set screw (8) on the housing (1) to the outer rotating driveshaft (5) which allows the unit to be removably secured to the machine for the purpose of servicing or replacement with the existing bobbin assembly. The outer shaft sits on a stationary inner shaft (6). To facilitate rotation, ball or roller bearings (7) are positioned between the outer and inner shafts. Since all models of sewing machines do not have the same bobbin configuration, the method by which the mechanism rotates on the shaft may also be by other means including a sleeve bearing. The left side of the mechanism is held in position by a spring loaded butterfly-wing stabilizer clip (14). The butterfly-wing stabilizer clip is in turn secured to a leg of the sewing table (25) via a bracket (26).

The two bobbins (10 and 11) are oriented in a side by side manner. The left side bobbin (10) is provided with a tab or protrusion (18) on its outer side and the right side bobbin (11) is provided with a complementary indentation (19) on its outer side (see FIG. 6). They are held in position relative to one another inside the housing by bobbin casings (12 and 13). Each of the two casings are provided with covers (22 and 23) to provide access to the bobbins when necessary. The covers are secured to the casings by means of spring-loaded ball bearings (15) which sit in races along the inside edge of the bobbin casings (see FIG. 5). Each combined bobbin casing and cover is fashioned in a hemispherical shape so that when placed adjacent to each other, they form a nearly spherical body in which the bobbins (10 and 11) reside. The inner surface of the housing (1) forms a partially spherical shape of nearly identical dimensions to those of the bobbin casings and covers which allows for small gaps between the bobbin casings themselves and between the bobbin casings and the housing.

Figure 5:
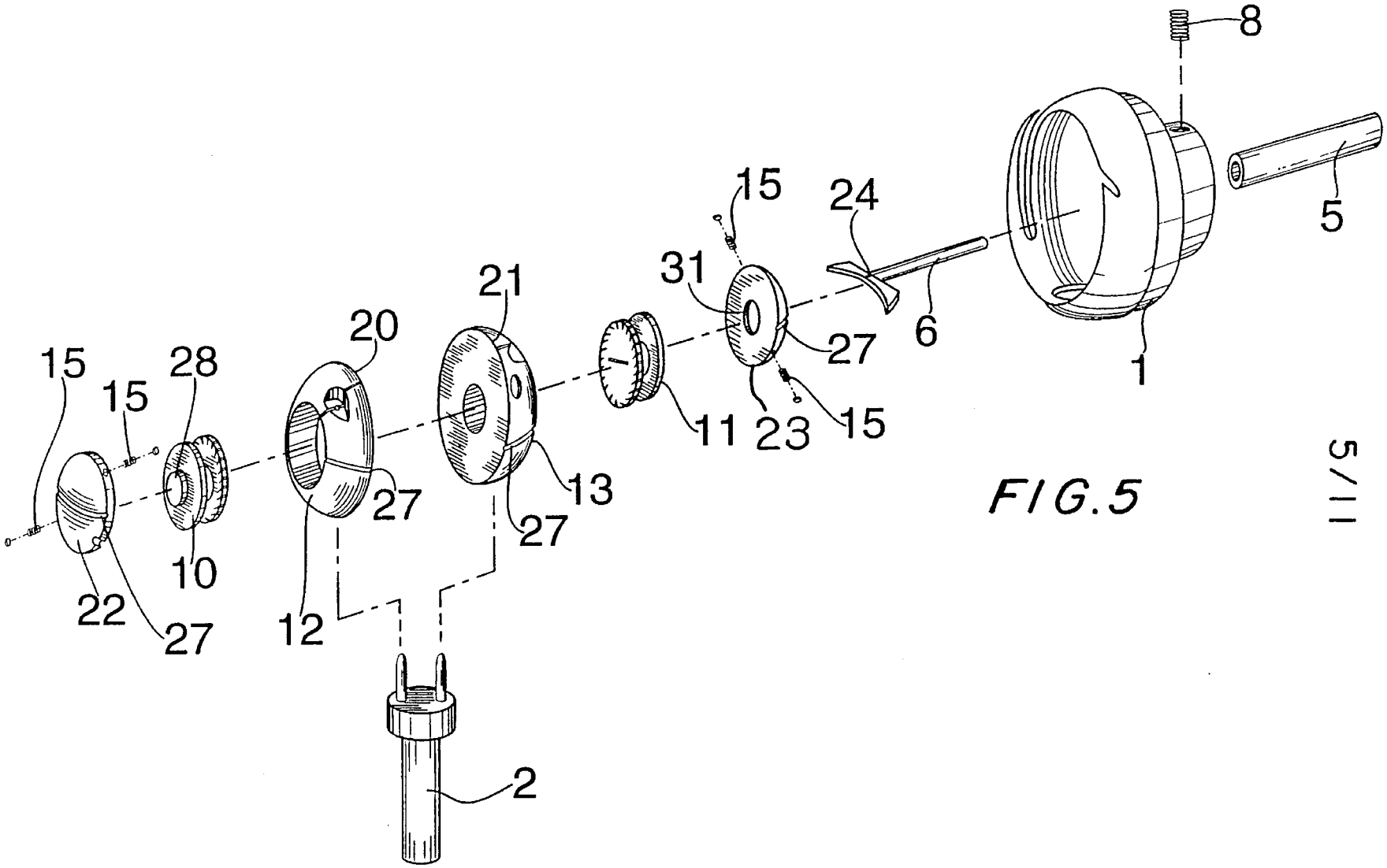
FIG. 5 is an exploded view of the dual bobbin mechanism and its interior components.

FIG. 5 is an exploded view of the unit. The right side bobbin (11) fits inside the right side bobbin casing (13). The right side bobbin casing (13) is enclosed on one side by the right side bobbin casing cap (23). The bobbin casing cap is provided with spring-loaded ball bearings (15) which sit in races along the inside edge of the bobbin casings to lock it in place on the casing. To permit free rotation of the bobbins within the casings, each bobbin includes a cylindrical protrusion (28 and 29) at the center of its outer side which communicates with a cylindrical indentation (30 and 31) on the bobbin casing cover to form a miniature axle. The end of the stationary inner shaft (6) is shaped as an arced blade which conforms to the curvature of the outer surface of the bobbin casings (12 and 13) and is provided with an opening (24) to allow the thread from the main supply (9) to exit the shaft and enter the housing. The assembled right hand bobbin, casing and cap then fits into the housing (1) with the arced blade communicating with a groove (27) on the outer surface of the bobbin casing and cover. The left side bobbin (10) is assembled into the left hand side bobbin casing (12) with left side bobbin casing cover (22) in place in a similar manner. The left hand bobbin casing (12) then fits inside the housing (1). The entire unit is then inserted on the rotating outer drive shaft (5) of the sewing machine and secured by the set screw (8).

A butterfly-wing stabilizer clip (14) is then positioned on the left side of the housing (with bobbin casings in place). The clip is made of a central body (32) with two spring-loaded arms or wings (33 and 34) located at either side of the central body. A tension is imparted to the arms by means of springs (35 and 36) placed behind the arms and secured by spring retaining screws (37 and 38). The range of motion of the arms is limited by the pins (39 and 40) which keep the arms attached to the central body. At the end of each arm is a wheel (46 and 47) provided with a tapered rolling surface. The tapered rolling surface conforms to the groove (27) cut along each of the bobbin casings and communicates in the same way that the stationary blade (6) does.

The central body is also provided with a plunger assembly to act as a braking mechanism for the bobbins. When necessary and as directed by existing sewing machine components and conditions, a hammer (41) is activated. The hammer is connected to a plunger (43) which extends beyond the central body and presses firmly against the left-hand bobbin casing. This serves to stop any rotation of the bobbins since the small gap between the bobbins is eliminated as the bobbins bear against each other and the bobbin casings. Such hammer and plunger activation may occur for example during bobbin rotation to maintain bobbin thread position. At the appropriate moment, again dictated by the existing sewing machine parameters, the hammer is released and the plunger spring (42) causes the plunger to retract back into the central body. The butterfly-wing stabilizer clip slides into a mounting boss (44) and the entire unit is secured to a bracket (26) by means of a threaded stud and nut assembly (45). The clip is in turn attached to a leg of the sewing table by any ordinary attaching means including nails, screws, etc.

Since the butterfly-wing stabilizer clip is spring loaded, it exerts a pressure against the left and right hand bobbin casings and the stationary blade. This force is strong enough to prevent unnecessary rotation of the bobbin casings about the sewing needle axis and to maintain the tapered wheels (46 and 47) and blade (6) in the groove (27) of the bobbin casings. These features allow the bobbins (10 and 11) to rotate inside their respective casings at the same time and rate of speed while the casings (12 and 13) remain stationary and float inside the housing (1) which spins at normal sewing machine speeds.

Figure 6:
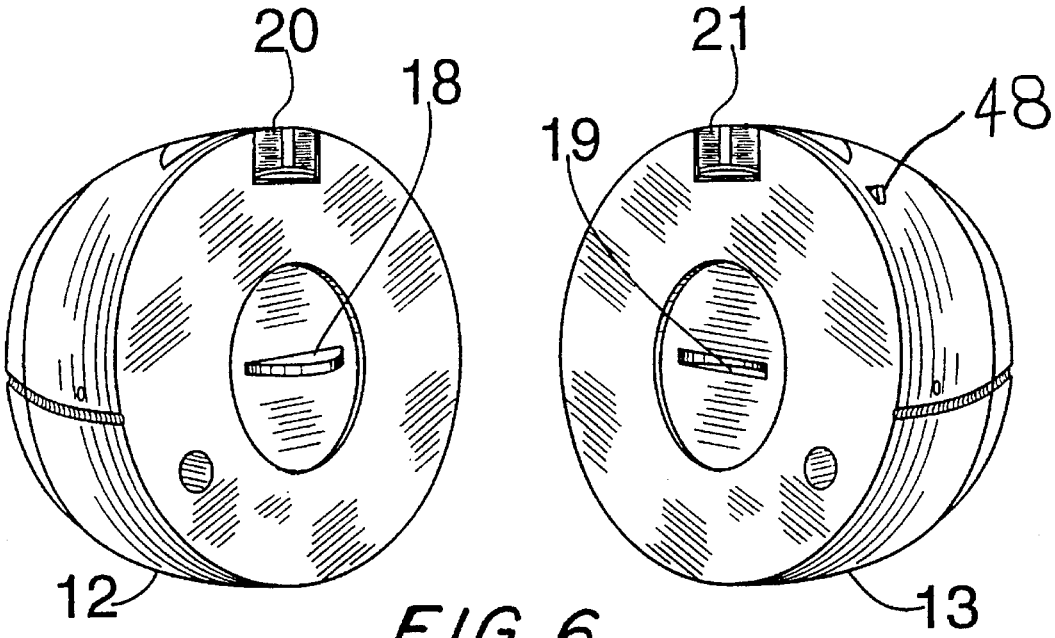
FIG. 6 is a perspective view of the left and right side bobbin casings with bobbins in place.
Figure 7:
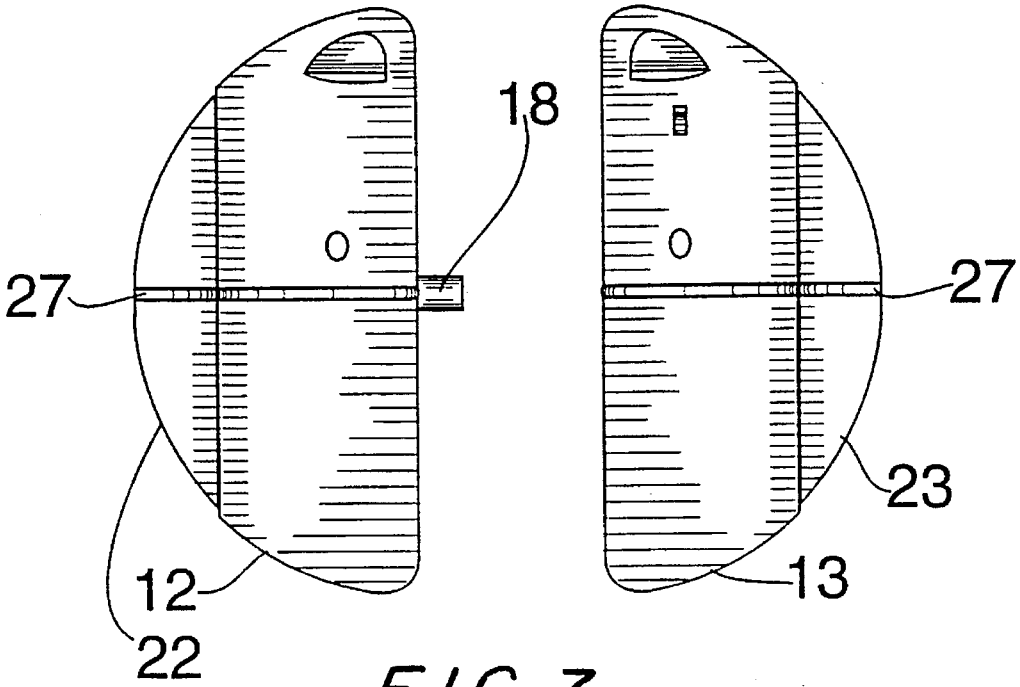
FIG. 7 is side view of the left and right side bobbin casings with bobbins in place.
Figure 8:
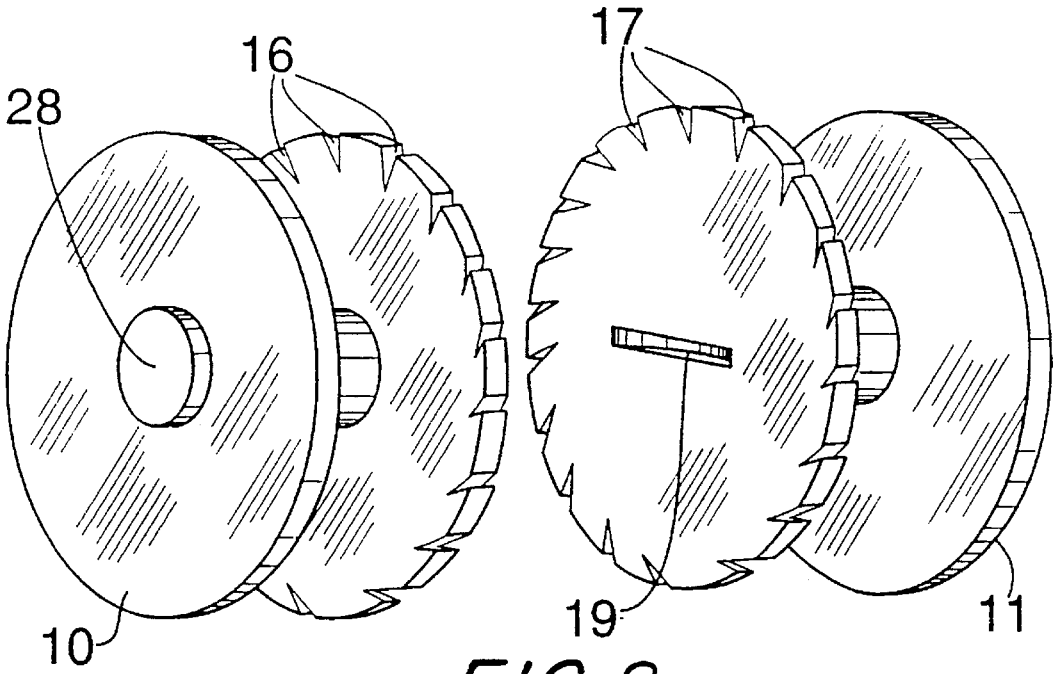
FIG. 8 is a perspective view of the left and right side bobbins removed from their casings.
Figure 9:
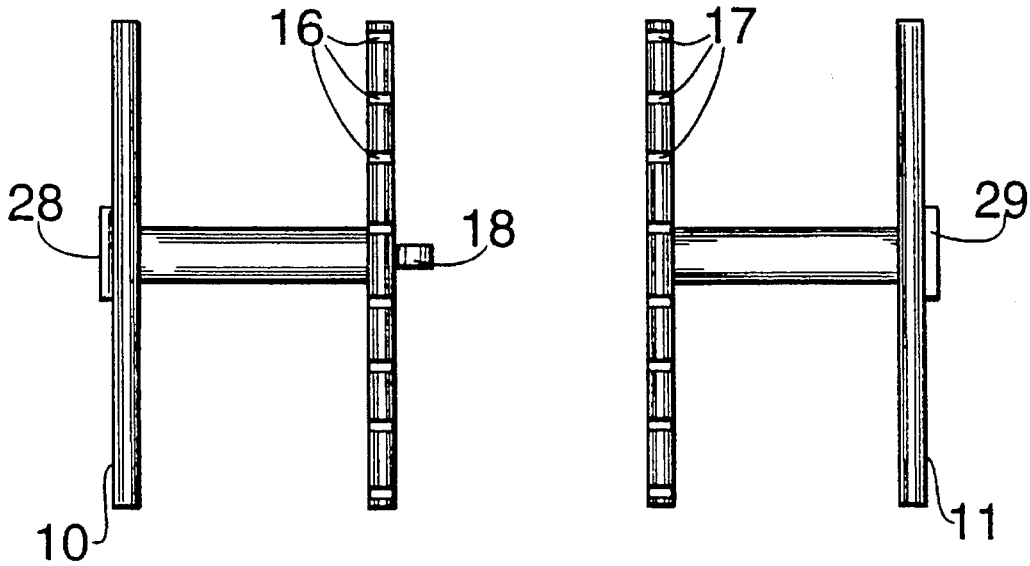
FIG. 9 is a top view of the left and right side bobbins removed from their casings.

More detailed views of the bobbins and bobbin casings are displayed in FIGS. 6, 7, 8 and 9. Both bobbins are provided with a number of serrations or miniature hooks (16 and 17) on the circumference of their inside edges for catching thread during the bobbin transfer process (see FIGS. 8 and 9). FIG. 6 shows a side-by-side view of the bobbin casings removed from the housing with bobbins in place. Both bobbin casings (12 and 13) contain thread transfer grooves (20 and 21) cut into the casings to allow the thread from the main thread supply to pass from the filled bobbin to the empty bobbin during the bobbin switching process. These grooves further act as a needle pocket which allow the sewing needle (4) access to the thread during sewing.

A complete dual bobbin assembly will contain the following: a full left side bobbin with thread coming up through the thread transfer groove (20) to catch needle thread, a right side bobbin empty whereby thread (9) from the main thread supply is caught by one of the serrations (17) in the right side bobbin so that refilling can commence and a manual digital counter or computerized monitor (not shown) which counts bobbin revolutions and has been preset to the number of revolutions required to empty the full left side bobbin (10).

Once these conditions have been established, sewing can commence. Sewing proceeds in a normal fashion with needle thread being hooked by hook portion (3) of rotating housing (1), fed around left side bobbin and catching the bobbin thread from the left hand bobbin in the loop created to complete the required stitch pattern. Once the preset number of bobbin revolutions is reached, the left and right side bobbin casings (12 and 13) will switch positions, i.e. left side will rotate 180° to right side and right side will rotate 180° to left side. Since the empty bobbin (11) was rotating at the same speed as full bobbin (10), it was being refilled by the main thread supply at the same rate at which thread was being removed from full bobbin (10).

The rotation of the bobbin casings is affected by a two-pronged pivot coupler (2) positioned beneath the mechanism. The pivot coupler moves up through an opening in the rotating housing and each prong engages an opening at the bottom of each bobbin casing. The two-pronged pivot coupler then rotates thereby spinning the bobbin casings 180° on an axis about the needle (4). Once this rotation is completed, the two-pronged pivot disengages from the bobbin casings and sewing can resume. In a preferred embodiment of the invention, the two-pronged pivot is connected to a solenoid which receives an electrical signal from the existing sewing machine components and rotates the bobbin casings. The two-pronged pivot may also be activated by other means and include, but are not limited to, other electromagnetic, magnetic or electromechanical means. Once the bobbin revolution counter reaches the preset value, it will trigger the mechanism for rotating the bobbin casings. On manual sewing machines, once the digital counter reaches the preset value, a lever arm connected to the two-pronged pivot can be operated to engage and rotate the bobbin casings.

During bobbin rotation, the thread (9) from the main thread supply is dragged around the bobbin casing (13). Once the casings are rotated the full 180°, the thread (9) from the main thread supply begins to travel across the groove (21) of the just-rotated casing (13) containing the full bobbin (11) through the groove (20) of casing (12) to the now empty bobbin (10). Thread (9) from the main supply, still under tension, is hooked by one of the now empty bobbin serrations (16) and is cut from the full bobbin thread due to the tension. The thread remains caught in the serration and begins refilling the empty bobbin (10) as sewing recommences. Thread from the newly filled, just rotated bobbin remains between the bobbin casings to be part of the new stitch. Simultaneously, the counter is reset to begin counting the number of new revolutions for the now full bobbin (11). The counter continues until the set number is reached which subsequently triggers the next rotation of the bobbins.

A better understanding of the operation of the mechanism and the travel path of the needle and bobbin threads is provided in FIGS. 10–13. Top views, side views and axial views in the figures show the housing in different positions as it passes through one rotation. For reference purposes, the inboard bobbin casing is the one concealed by the rotating housing and the outboard bobbin casing is the exposed bobbin casing in contact with the butterfly wing stabilizer clip.

Figure 10B:
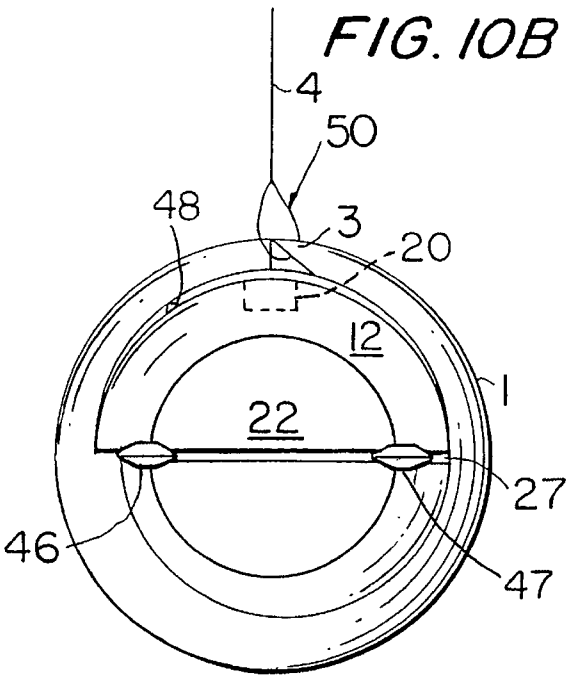
FIG. 10 shows the dual bobbin mechanism from different views when rotation angle equals 0°.
Figure 10A:
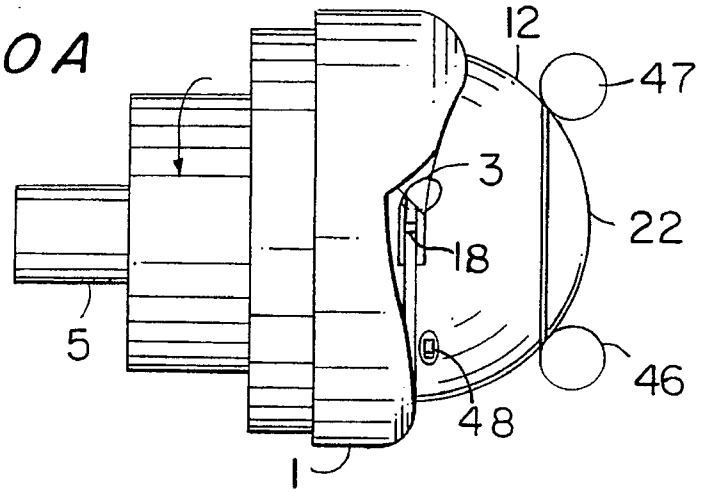
Figure 10C:
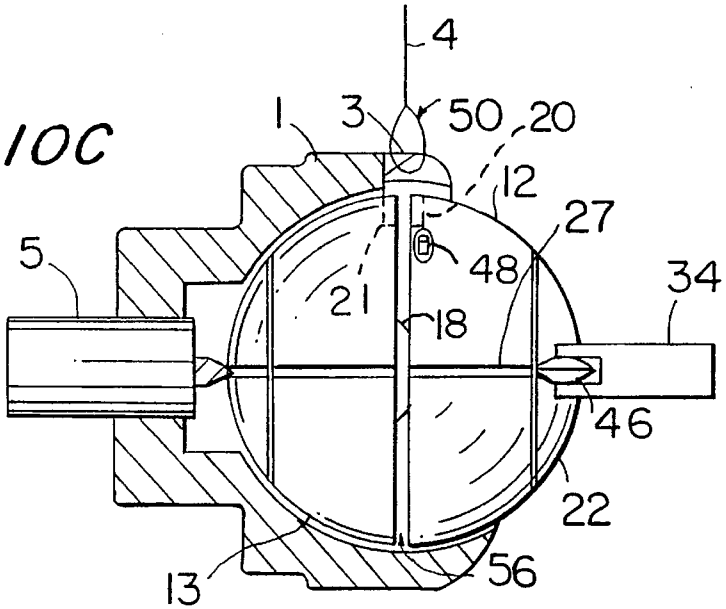

FIG. 10 shows the housing at rotation $\angle=0°$. At this point, the thread hook on the housing is at the twelve o'clock position and is just about to catch the looped needle thread. The loop exists as one end of the needle thread is already part of the previous stitch in the fabric being sewn and the other end being partially slackened by the constant up-and-down movement of the needle causing slight tugging and releasing at the needle thread source.

Figures 11A, 11B:
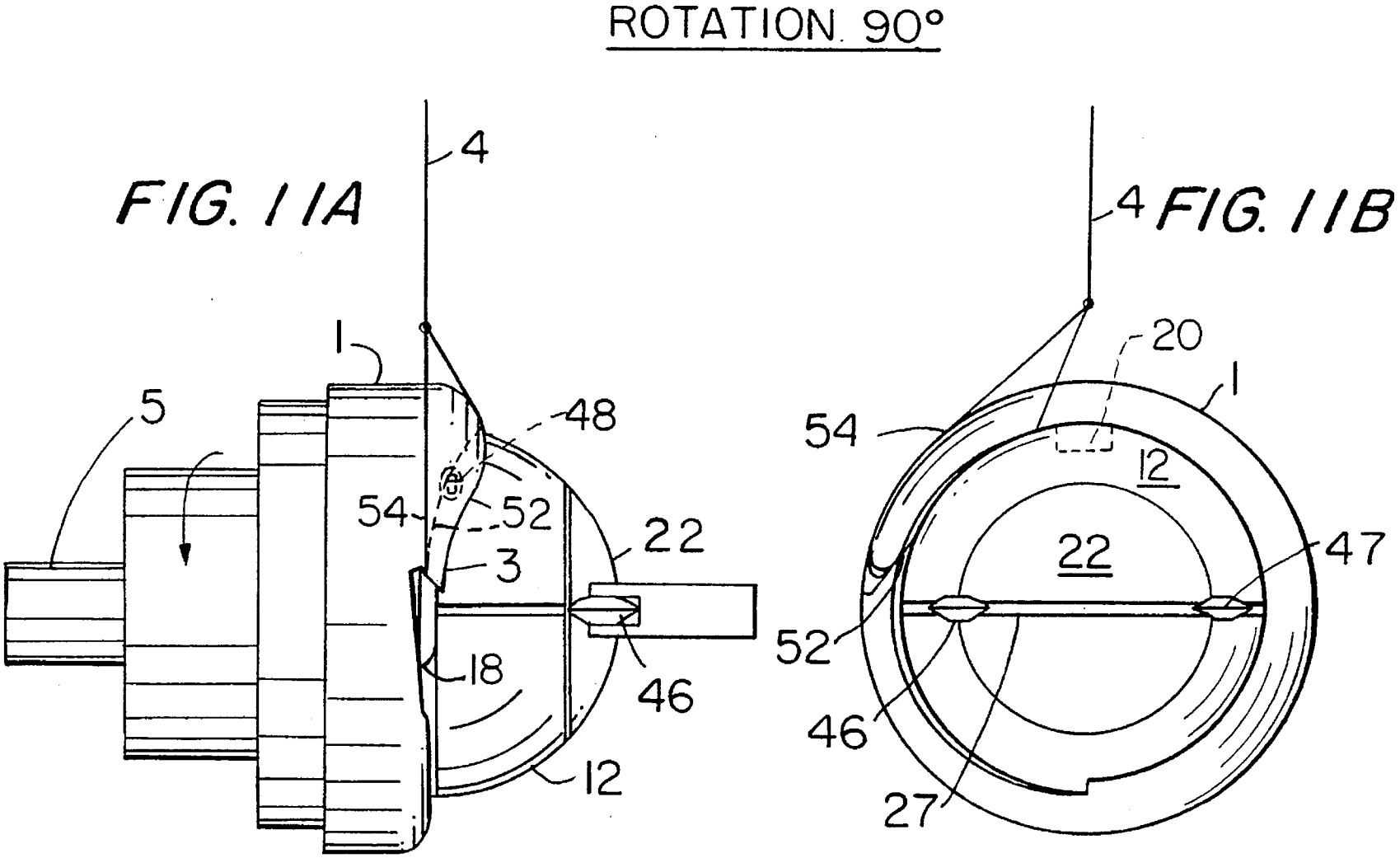
FIG. 11 shows the dual bobbin mechanism from different views when rotation angle equals 90°.

At rotation $\angle=90°$, shown in FIG. 11, the needle thread has been grabbed by the hook portion of the rotating housing. One end of the needle thread (the inner needle thread portion) tucks under the hook slightly and is hooked by a secondary positioning hook (48) on the outer surface of the bobbin casing in the outboard position. The other end (the outer needle thread portion) is pulled taut and dragged around the outside of the outboard bobbin casing, following the contour of the housing.

At rotation $\angle=180°$, shown in FIG. 12, the contour of the housing continues to push the outer needle thread portion around the outboard bobbin casing until it reaches the first tapered wheel of the butterfly-wing stabilizer clip. The clip is spring loaded to an appropriate tension and the tapered wheels (46 and 47) and bobbin casing grooves (27) are dimensioned to allow slight play or left/right shifting of the bobbin casings, but not so much as to totally immobilize them. As such, the relatively thin outer needle thread portion passes between the first tapered wheel and the outboard casing without detrimentally effecting the relative positioning of the casing. The tension in the outer needle thread portion and contour of the rotating housing continue to pull the thread around the casing and past the second tapered wheel. With the needle thread loop now sufficiently large and the tension in the needle thread pulling it around the casing, the inner needle thread portion begins sliding between the outboard and inboard bobbin casings.

At rotation ∠=270°, the combination of the needle thread tension and upward movement of the needle itself draws the needle thread up in the gap between the outboard and inboard bobbin casings. As mentioned earlier, one bobbin is provided with a protrusion on its outer side which indexes with a complementary indention on the outer side of the other bobbin. Similar to the bobbin casing grooves (27), this protrusion and indentation are dimensioned to allow slight play or shifting of the bobbin casings. Therefore, as the tension in the needle thread pulls it past the bobbins' protrusion and indentation, the spring-loaded butterfly clip absorbs any minor jump or shock between the bobbin casings without detrimentally effecting the positioning of the casings within the housing.

Figure 13B:
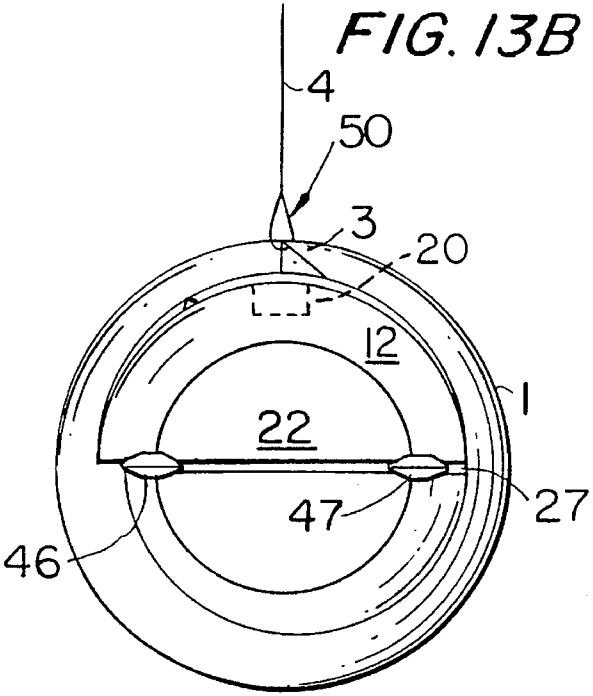
FIG. 13 shows the dual bobbin mechanism from different views when rotation angle equals 360°.
Figure 13A:
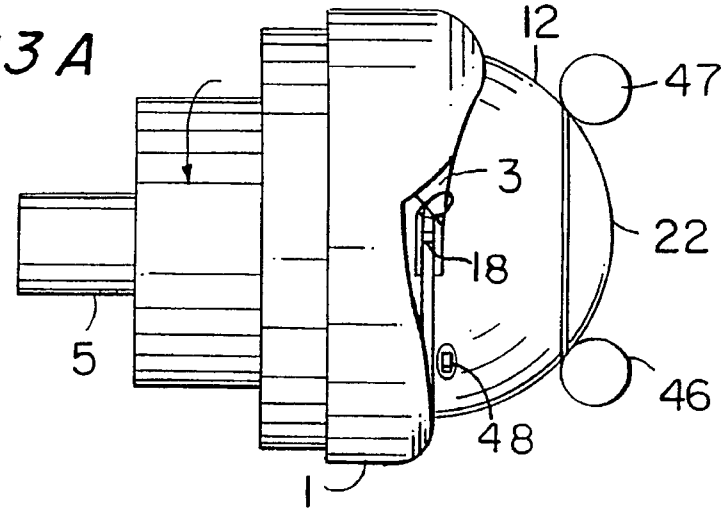
Figure 13C:
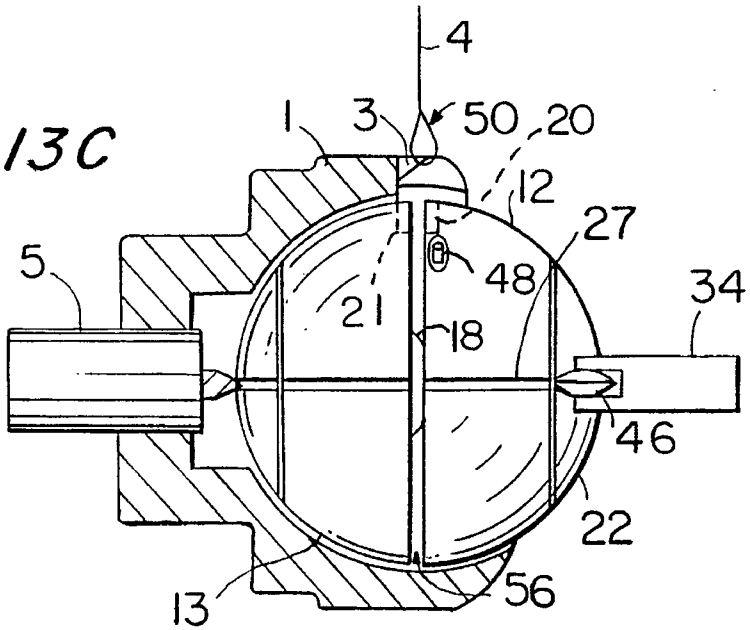

At rotation ∠=360°, shown in FIG. 13, the needle thread is completely around the outboard bobbin and up through the gap between the outboard and inboard bobbin casings. The completed loop grabs a portion of bobbin thread (also between the casings) and the stitch is drawn into the fabric by the needle. As the needle moves downward again, the next small loop is created and the thread hook (3) on the housing engages the needle thread in preparation for a new stitch formation.

The operation of this device results in momentarily halting the sewing process while bobbins are switched and the empty bobbin is prepared for refilling. The advantages of this mechanism over previous types of bobbin changing systems is that bobbins are never removed from their casings to effect respooling. Further, the simplicity of design eliminates the need for cumbersome bobbin switching means including carriages, cams, rotating arms, etc. This reduction in the number of moving parts reduces the possibility of breakdown due to frictional heat, build-up of residual thread fuzz around thread hook rotary, and loss of lubrication, thereby increasing reliability of the overall system and improving machine and operator efficiency.

While the preferred embodiment of the invention has been described in detail, alternate embodiments will become obvious to those skilled in the art after reading this disclosure. These variations are to be considered within the scope and spirit of the subject invention. Consequently, the subject invention is only to be limited by the claims which follow and their equivalence.

What is claimed is:

1. A dual bobbin mechanism for use on a sewing machine which comprises:

two bobbins;

means for maintaining the two bobbins in a side-by-side configuration whereby both bobbins spin at the same time and speed, a first bobbin being located in a position defining a stitching-thread-supply position and a second bobbin being located in a position defining a thread-respooling position;

means for rotating the two bobbins to allow for repositioning of a full bobbin in the thread-respooling position to the stitching-thread-supply position and an empty bobbin in the stitching-thread-supply position to the thread-respooling position; and means for the automatic rethreading of the empty bobbin from an external thread source to begin respooling.

2. A dual bobbin mechanism of claim 1 wherein the means for maintaining the two bobbins in a side-by-side configuration comprise:

an indentation on a side of one of the bobbins shaped and dimensioned to engage with a protrusion on a side of the other bobbin, a substantially hemispherically-shaped combination first-half bobbin casing and first-half bobbin-casing cover and a substantially hemispherically-shaped combination second-half bobbin casing and second-half bobbin-casing cover, each bobbin casing accommodating one of said bobbins so that the protrusion and indentation engage with each other, a needle-thread-hook housing removably attachable to an outer tubular, rotatable driveshaft of a driveshaft assembly of the sewing machine, the inner surface of the housing being partially spherical in shape and dimensioned to accommodate both of the substantially hemispherically-shaped bobbin casings, the needle-thread-hook housing having an opening for receiving an inner, stationary shaft of the driveshaft assembly of the sewing machine, the first-half bobbin casing being shaped to engage an end of the inner, stationary shaft of the driveshaft assembly which can extend into the needle-thread-hook housing so that in operation the first-half bobbin casing can be prevented from rotating with the housing by engaging with said end of the inner, stationary shaft, and a spring-loaded butterfly-wing stabilizer clip fixedly positionable relative to the sewing machine such that the stabilizer clip can impart a force against the second-half bobbin casing so that in operation the second-half bobbin casing can be prevented from rotating with the housing.

3. A dual bobbin mechanism of claim 2 wherein the portion of the inner driveshaft extending into the housing is fashioned as an arced blade that communicates with a groove on the bobbin casings and bobbin casing covers to keep them from rotating with the housing.

4. A dual bobbin mechanism of claim 2 wherein the butterfly wing stabilizer clip comprises:

a central body, a pair of spring-loaded arms connected to either side of the body, the end of each arm fitted with a wheel with a tapered rolling surface which communicates with the groove on the bobbin casings and bobbin casing covers to keep them from rotating with the housing, a spring loaded hammer and plunger assembly passing longitudinally through the midsection of the central body for use as a bobbin braking mechanism and a mounting boss slidably mounted to said clip for securing said clip to a permanent location in relation to the sewing machine and dual bobbin mechanism.

5. A dual bobbin mechanism of claim 1 wherein the means for rotating the bobbins comprise a dual-pronged pivot located below the housing and attached to an engaging and turning device, the engaging and turning device, controlled by existing sewing machine components and parameters, whereby the dual-pronged pivot, upon an appropriate activation signal from the sewing machine, moves up through an opening in the housing, engages an opening at the bottom of each of said bobbin casings, turns 180° on an axis common with a needle of the sewing machine, thereby rotating the bobbins and bobbin casings and retracts below the housing to allow sewing to continue.

6. A dual bobbin mechanism of claim 5 wherein the device for engaging and turning the bobbin casings is a solenoid.

7. A dual bobbin mechanism of claim 1 wherein the means for automatic rethreading of the empty bobbin comprise:

a thread transfer groove cut into each bobbin casing and a plurality of hook serrations integrated on the circumference of an inside edge of each bobbin whereby thread from the external thread source, under tension, travels along the thread transfer groove from the full bobbin to the empty bobbin after rotation of the bobbins, is caught by one of the hook serrations of the empty bobbin, is pulled taut and cut from the full bobbin due to tension, remains caught on the hook serration and begins respooling the empty bobbin.

8. A dual bobbin mechanism of claim 2 wherein the needle thread hook housing is contoured so as to allow a hooked portion of needle thread from the sewing machine to be looped around the surface of the left-side bobbin casing and up in between the left-side and right-side bobbin casings to catch bobbin thread.

* * * * *